United States Patent [19]

Donohue

[11] Patent Number: 4,512,917

[45] Date of Patent: Apr. 23, 1985

[54] HEXABORIDE RESISTOR COMPOSITION

[75] Inventor: Paul C. Donohue, Wilmington, Del.

[73] Assignee: E. I. Du Pont de Nemours and Company, Wilmington, Del.

[21] Appl. No.: 581,601

[22] Filed: Feb. 21, 1984

Related U.S. Application Data

[63] Continuation-in-part of Ser. No. 525,507, Aug. 22, 1983, abandoned.

[51] Int. Cl.[3] ..... H01B 1/06

[52] U.S. Cl. ..... 252/521; 252/518; 338/20; 338/308; 338/309; 427/101; 427/102; 427/279; 427/376.2

[58] Field of Search ..... 252/521, 518; 106/20, 106/26, 193 R, 1.05; 428/432, 688; 29/610 R, 620, 621; 338/20, 308, 309, 313; 427/101, 102, 103, 126.1, 126.2, 279, 376.2, 376.3

[56] References Cited

U.S. PATENT DOCUMENTS

| | | | |
|---|---|---|---|
| 4,225,468 | 9/1980 | Donohue et al. | 252/521 |
| 4,237,084 | 12/1980 | Payne et al. | 252/521 |
| 4,260,525 | 4/1981 | Olsen et al. | 252/518 |
| 4,420,338 | 12/1983 | Ortega | 252/521 |

FOREIGN PATENT DOCUMENTS

| | | |
|---|---|---|
| 0008437 | 3/1982 | European Pat. Off. . |
| 2397704 | 5/1979 | France . |
| 1282023 | 7/1972 | United Kingdom . |

OTHER PUBLICATIONS

Izvestiia Vysshikh Uchebnykh Zavadenii, Neft'i y Gaz. 16 (6), 99–102, (1973).

*Primary Examiner*—Josephine L. Barr

[57] ABSTRACT

A composition for the preparation of thick film resistors comprising an admixture of finely divided particles of a conductive metal hexaboride and a crystallizable glass frit which is irreducible by the metal hexaboride containing at least 5 mole % of $Ta_2O_5$ which is reducible by the metal hexaboride under normal firing conditions.

8 Claims, No Drawings

HEXABORIDE RESISTOR COMPOSITION

CROSS-REFERENCE TO RELATED APPLICATION

This application is a continuation-in-part of U.S. patent application Ser. No. 525,507 filed Aug. 22, 1983 now abandoned.

FIELD OF THE INVENTION

The invention is directed to compositions which are useful for making thick film resistors and particularly to such compositions in which the conductive phase is based upon hexaboride compounds.

BACKGROUND OF THE INVENTION

Thick film materials are mixtures of metal, glass and/or ceramic powders dispersed in an organic medium. These materials are applied to nonconductive substrates to form conductive, resistive or insulating films. Thick film materials are used in a wide variety of electronic and light electrical components.

The properties of individual compositions depend on the specific constituents which comprise the compositions. All compositions contain three major components. The conductive phase determines the electrical properties and influences the mechanical properties of the final film. In conductor compositions, the conductive phase is generally a precious metal or mixture of precious metals. In resistor compositions, the conductive phase is generally a metallic oxide. In dielectric compositions, the functional phase is generally a glass or ceramic material.

The binder is usually a glass which holds the film together and binds it to the substrate. The binder also influences the mechanical properties of the final film.

The organic medium or vehicle is a solution of polymers in organic solvents. The vehicle determines the application characteristics of the composition.

In the composition, the functional phase and binder are generally in powder form and have been thoroughly dispersed in the vehicle.

Thick film materials are applied to a substrate. The substrate serves as a support for the final film and may also have an electrical function, such as a capacitor dielectric. Substrate materials are generally nonconducting.

The most common substrate materials are ceramics. High-purity (generally 96%) aluminum oxide is the most widely used. For special applications, various titanate ceramics, mica, beryllium oxide and other substrates are used. These are generally used because of specific electrical or mechanical properties required for the application.

In some applications where the substrate must be transparent—such as displays—glass is used.

Thick film technology is defined as much by its processes as by the materials or applications. The basic thick film process steps are screen printing, drying and firing. The thick film composition is generally applied to the substrate by screen printing. Dipping, banding, brushing or spraying are occasionally used with irregular-shaped substrates.

The screen printing process consists of forcing the thick film composition through a stencil screen onto the substrate with a squeegee. The open pattern in the stencil screen defines the pattern which will be printed onto the substrate.

After printing, the film is dried and fired—generally in air at a peak temperature of 500°-1000° C. This process forms a hard, adherent film with the desired electrical and mechanical properties.

Additional thick film compositions may be applied to the same substrate by repeating the screen printing, drying and firing processes. In this way, complex, interconnected conductive, resistive and insulating films can be generated.

Thick film resistor compositions are usually produced in decade resistance values and materials are available that provide a wide range of sheet resistance (0.5 Ω/□ to $1\times10^9$ Ω/□). A change in aspect ratio, length to width, of a resistor will provide resistance values lower than 0.5 Ω/□ and higher than $1\times10^9$ Ω/□ and any intermediate resistance value.

Composition blending is a technique widely used to obtain a resistance value between standard decade values. Adjacent decade members can be mixed in all proportions to produce intermediate values of sheet resistance. The mixing procedure is simple but requires care and the proper equipment. Usually blending has minimal effect on Temperature Coefficient of Resistance (TCR).

High electrical stability and low process and refire sensitivity are critical requirements for thick film resistor compositions for microcircuit applications. In particular, it is necessary that the resistance (R) of the films be stable over a wide range of temperature conditions. Thus, TCR is a critical variable in any thick film resistor composition. Because thick film resistor compositions are comprised of a functional or conductive phase and a permanent binder phase, the properties of the conductive and binder phases and their interactions with each other and with the substrate affect both resistivity and TCR.

Since copper is an economical electrode material, there is a need for thick film resistor systems which are compatible with copper and fireable in a nonoxidizing atmosphere and which have properties comparable to air fired resistors. Among the resistance materials which have been suggested for this purpose are lanthanum hexaboride, yttrium hexaboride, rare earth hexaborides and alkaline earth hexaborides. In this regard, Baudry et al. in French Pat. No. 2,397,704 have suggested resistance materials which are stable in a nonoxidizing firing atmosphere comprising an admixture of finely divided particles of a metal hexaboride and a glass frit which is an alkaline earth metal boroaluminate. In the Baudry patent, it is disclosed that the glass, which does not react with metal hexaborides, may contain no more than about 1% by volume metal oxides which are reducible by the metal hexaboride. Furthermore, in applicant's EPO Patent No. 0008437 are disclosed resistance materials which are comprised of an admixture of finely divided particles of metal hexaboride and a glass which is not reducible by the metal hexaboride. In this patent, it is disclosed that the glass may contain no more than 2 mole % of reducible metal oxides. In addition, U.S. Pat. No. 4,225,468 to Donohue is directed to similar hexaboride resistance materials comprising an admixture of finely divided particles of metal hexaboride, nonreducing glass and various TCR modifiers dispersed therein in particulate form, including particles of TiO and NbO.

Izvestia Vysshikl Uchebnykl Zavendenii, Nefti y Gaz, 16 (6), 99-102 (1973), discloses thick film resistors based on relatively coarse $LaB_6$ and borosilicate glass. These resistors are said to be resistant to hydrogen gas; however, the films are moisture sensitive.

British Pat. No. 1,282,023, published July 19, 1972, discloses electrical resistor dispersions containing rare earth of alkaline earth hexaboride conductive pigment and a glass phase dispersed in ethyl cellulose medium. The glasses used are lead borosilicates as well as lead aluminoborosilicates, the latter of which is shown to contain as little as 16 mole % of hexaboride reducible oxides of low melting metals such as Pb, Na, Co and Ni. While such metal hexaboride-based resistors have been found to be quite useful, they nevertheless have also been found to be somewhat limited in their power handling capability, especially when they are formulated to make resistance materials in the 1K–100K ohm range. More recently, Francis-Ortega in U.S. Pat. No. 4,420,338 discloses resistors of metal hexaborides containing alkaline earth silicoborate glasses modified with small amounts (less than 5 mole %) of reducible oxides of V, Nb and Ta. The purpose of the reducible oxide is purported to be to improve TCR. However, it has been found that such oxides react with the hexaborides to form either diboride particles or metals which progressively lower the resistance. This process instability is shown by excessive lowering of the resistance on refiring.

BRIEF DESCRIPTION OF THE INVENTION

The disadvantages of the prior art hexaboride resistance materials with respect to power handling capability and electrical stability, process sensitivity and refire characteristics are substantially overcome by the invention, which is directed primarily to a composition for the preparation of thick film resistors comprising an admixture of finely divided particles of:

A. 2–70% by weight, basis total solids, of conductive metal hexaboride selected from the group consisting of $LaB_6$, $YB_6$, rare earth hexaboride, $CaB_6$, $SrB_6$ and mixtures thereof; and B. 98–30% by weight, basis total solids, of a crystallizable glass comprising up to 95 mole % components which are irreducible by the conductive metal hexaboride having dissolved therein at least 5 mole % $Ta_2O_5$, which is reducible by the conductive metal hexaboride to form $TaB_2$ and crystalline tantalate phases.

In a secondary aspect, the invention is directed to the method of making a resistor element comprising the sequential steps of:

1. Forming a dispersion in organic medium of the above described hexaboride-containing composition;
2. Forming a patterned thin layer of the dispersion of step 1;
3. Drying the layer of step 2; and
4. Firing the dried layer of step 3 in a nonoxidizing atmosphere to effect reduction of the reducible metal oxides, volatilization of the organic medium and liquid phase sintering of the glass.

The invention is also directed to resistors made by the above described method.

DETAILED DESCRIPTION OF THE INVENTION

A. Metal Hexaboride

The primary conductive phase component of the invention is the same as taught in applicant's EPO Patent No. 000837, referred to hereinabove. That is, suitable conductive phase materials are $LaB_6$, $YB_6$, the rare earth hexaborides, $CaB_6$, $BaB_6$, $SrB_6$ or mixtures thereof. Although the above empirical formulae are used throughout this description, it is understood that the stoichiometry of these compounds is somewhat variable and is thought to be, e.g., for lanthanum hexaboride, $La_{0.7\text{-}1}B_6$. Of the foregoing listed metal hexaborides, $LaB_6$ is preferred.

As is also pointed out in the above-referred EPO Patent No. 0008437, it is preferred that the hexaboride particle size be below one micron (μm). Preferably, the average particle size is between 0.055 μm and 0.32 μm and, even more preferably, the average particle size is approximately 0.2 μm. The particle size referred to above can be measured by a Coulter Counter or can be calculated, assuming spherical particles, from the equation below:

$$\text{Particle Diameter } (\mu m) = \frac{6}{\text{Surface Area } (m^2/g) \times \text{Density } (g/cm^3)}$$

The surface area can be determined by customary methods such as measuring weight gain after equilibrium gas adsorption by the particles. For $LaB_6$, the density is 4.72 $g/cm^3$. Substituting into the above equation, the surface area for $LaB_6$ has to be larger than approximately 1 $m^2/g$, while the preferred surface area range is approximately 4–23 $m^2/g$, with the more preferred value being approximately 6 $m^2/g$. To obtain the fine particle size hexaborides of this invention from commercially available coarser materials, e.g., 5.8 μm for $LaB_6$, they are usually vibratorily milled. Vibratory milling is carried out in an aqueous medium by placing the inorganic powder and alumina balls into a container which is then vibrated for a specified length of time to achieve the desired particle size referred to in the above referred EPO Patent No. 0008437, which is incorporated herein by reference.

The compositions of the invention will ordinarily contain 2–70% by weight, basis total solids, of the metal hexaboride and preferably 5–50%.

B. Glass

The glass component of the invention must both crystallizable and substantially nonreducing. Suitable crystallizable glasses are the alkali metal and alkaline metal aluminosilicates and especially boroaluminosilicates, examples of which are as follows:

$Li_2O.Al_2O_3.SiO_2$
$CaO.MgO.Al_2O_3.SiO_2$
$2MgO.2Al_2O_3.5SiO_2$
$K_2O.MgO.Al_2O_3.SiO_2.B_2O_3.F$
$MgO.Al_2O_3.SiO_2$
$BaO.Al_2O_3.2SiO_2$
$SiO_2.LiAlO_2.Mg(AlO_2)$.

In addition, crystallizable glasses many of which are suitable for use in the invention here are disclosed in U.S. Pat. No. 4,029,605 to Kosiorek. These glasses have the following composition:

$SiO_2$—40–70%
$Al_2O_3$—10–31%
$Li_2O$—3–20%
$B_2O_3$—2–15%

These glasses are shown to contain optionally small amounts of $As_2O_3$, $Na_2O$, $K_2O$ and $Bi_2O_3$. However, for use in the invention, the amounts of such oxides must be limited to less than 2% if they are reducible by hexaboride. Another class of crystallizable glass suitable for the invention has the following composition:

$SiO_2$—35–55%
$Al_2O_3$—5–15%
CaO, SrO or BaO—10–30%
$B_2O_3$—20–35%

These glasses may also contain optionally small amounts of $ZrO_2$ (≦4%), $TiO_2$ (≦1%) and $Li_2O$ (≦2%).

In addition to the above-referred basic glass components, the glasses for use in the invention must contain dissolved therein at least 5% $Ta_2O_5$, which is believed to function as a nucleating agent. Furthermore, within certain narrow limits, the glass, excluding the $Ta_2O_5$ must be substantially nonreducing. It is preferred that the glass contain at least 5.5% of the $Ta_2O_5$, but not more than 10%.

As used herein, the term "reducible" and "nonreducible" refer to the capability or lack thereof of the metal oxide to react with the metal hexaborides under the nonoxidizing firing conditions to which the compositions are subjected in ordinary use. More particularly, nonreducible glass components are deemed to be those having a Gibbs free energy of formation (Δ F.°) of −78 kcal/mole per O in the formula unit or of greater negativity. Conversely, reducible glass components are deemed to be those having a Gibbs free energy of formation (Δ F.°) of lesser negativity than −78 kcal/mole per O in the formula unit, e.g., −73.2 kcal/mole. The determination of the Gibbs free energy of formation is described in the above referred EPO patent.

Suitable component oxides of the nonreducible glasses of this invention include the following (Δ F.° (M-O) values at 1200° K. in kcal/mole per moiety of oxygen as shown in parentheses): CaO (−121), $ThO_2$ (−119), BeO (−115), $La_2O_3$ (−115), SrO (−113), MgO (−112), $Y_2O_3$ (−111), rare earth oxides, $Sc_2O_3$ (−107), BaO (−106), $HfO_2$ (−105), $ZrO_2$ (−103), $Al_2O_3$ (−103), $Li_2O$ (−103), TiO (−97), $CeO_2$ (−92), $TiO_2$ (−87), $SiO_2$ (−80), $B_2O_3$ (−78). $SiO_2$ and $B_2O_3$ appear to be borderline in reducibility but are believed to receive additional stabilization during glass formation and, therefore, as a practical matter, are included in the irreducible category.

The nonreducible components of the glass constitute no more than 95 mole % of the total glass. The amount will ordinarily be a function of the solderability of the reducible oxides contained therein. However, at least 70 mole % and preferably at least 85 mole % nonreducible components are preferred. From 90 to 95 mole % appears to be optimum.

Unlike the metal hexaboride resistors of applicant's EPO Patent No. 0004823, the resistor composition of this invention must contain at least 5 mole % and preferably at least 5.5 mole % $Ta_2O_5$ dissolved in the otherwise nonreducible glass. The Gibbs free energy (Δ F.°) of $Ta_2O_5$ is −73.2 kcal/mole at 900° C. Thus, it can reduced by $LaB_6$.

Because of its high melting point, the reduced Ta metal does not sinter. It remains very finely divided and, as such, contributes to the conduction of the resistor. The fine particle size and high dispersion produces resistors with lowered resistance.

The reduced metal reacts further to form a boride, e.g., $TaB_2$ which is highly dispersed and finely divided as evidenced by x-ray diffraction of the fired resistors. This in situ prepared boride also contributes to the conduction and stability of the resistor. However, they also produce sensitivity in the form of progressively lower resistance. By using a sufficiently high content of $Ta_2O_5$ in conjunction with a crystallizable glass, $CaTa_4O_{11}$ is formed which does not lower resistance. The $CaTa_4O_{11}$ does not appear to be formed if the $Ta_2O_5$ concentration is less than about 5 mole %.

In addition to the above-listed metal hexaboride-reducible metal oxides which must be present in solution in the glass to the extent of at least 5 mole % (preferably at least 5.5 mole %), the glass can also contain a quite small amount of other reducible metal oxides; that is, those in which the melting point of the metal is less than 2000° C. However, the amount of these other materials must be maintained within quite narrow limits and in all instances must be less than 2 mole % and preferably less than 1 mole % of the glass. Such further permissible reducible oxides include $Cr_2O_3$, MnO, NiO, FeO, $V_2O_5$, $Na_2O$, ZnO, $K_2O$, CdO, MnO, NiO, FeO, $V_2O_5$, PbO, $Bi_2O_3$, $Nb_2O_5$, $WO_3$ and $MoO_3$.

The surface area of the glass is not critical but is preferably in the range of 2–4 $m^2/g$. Assuming a density of approximately 3 $g/cm^2$, this range corresponds to an approximate particle size range of 0.5–1 μm. A surface area of 1.5 $m^2/g$ (approx. 1.3 μm) can also be utilized. The preparation of such glass frits is well known and consists, for example, in melting together the constituents of the glass in the form of the oxides of the constituents and pouring such molten composition into water to form the frit. The batch ingredients may, of course, be any compound that will yield the desired oxides under the usual conditions of frit production. For example, boric oxide will be obtained from boric acid, silicon dioxide will be produced from flint, barium oxide will be produced from barium carbonate, etc. The glass is preferably milled in a ball-mill with water to reduce the particle size of the frit and to obtain a frit of substantially uniform size.

The glasses are prepared by conventional glassmaking techniques by mixing the desired components in the desired proportions and heating the mixture to form a melt. As is well known in the art, heating is conducted to a peak temperature and for a time such that the melt becomes entirely liquid and homogeneous. In the present work, the components are premixed by shaking in a polyethylene jar with plastic balls and then melted in a platinum crucible at the desired temperature. The melt is heated at the peak temperature for a period of 1–1½ hours. The melt is then poured into cold water. The maximum temperature of the water during quenching is kept as low as possible by increasing the volume of water to melt ratio. The crude frit after separation from water is freed from residual water by drying in air or by displacing the water by rinsing with methanol. The crude frit is then ball-milled for 3–5 hours in alumina containers using alumina balls. Alumina picked up by the materials, if any, is not within the observable limit as measured by X-ray diffraction analysis.

After discharging the milled frit slurry from the mill, the excess solvent is removed by decantation and the frit powder is air dried at room temperature. The dried powder is then screened through a 325 mesh screen to remove any large particles.

The compositions of the invention will ordinarily contain 95–30% by weight, basis total solids, of inorganic glass binder and preferably 85–50%.

C. Organic Medium

The inorganic particles are mixed with an essentially inert liquid organic medium (vehicle) by mechanical mixing (e.g., on a roll mill) to form a pastelike composition having suitable consistency and rheology for screen printing. The latter is printed as a "thick film" on conventional dielectric substrates in the conventional manner.

Various organic liquids, with or without thickening and/or stabilizing agents and/or other common additives, may be used as the vehicle. Exemplary of organic liquids which can be used are the aliphatic alcohols, esters of such alcohols, for example, acetates and propionates, terpenes such as pine oil, terpineol and the like, solutions of resins such as the polymethacrylates of lower alcohols, and solutions of ethyl cellulose in solvents such as pine oil, and the monobutyl ether of ethylene glycol monoacetate. The vehicle may contain volatile liquids to promote fast setting after application to the substrate.

One particularly preferred vehicle is based on copolymers of ethylene-vinyl acetate having at least 53% by weight of vinyl acetate to form a resistor composition paste.

The preferred ethylene-vinyl acetate polymers to be utilized in vehicles for this invention are solid, high molecular weight polymers having melt flow rates of 0.1–2 g/10 min. The above vinyl acetate content limitation is imposed by the solubility requirements, at room temperature, of the polymer in solvents suitable for thick film printing.

Such vehicles are described in copending application to D. H. Scheiber, Ser. No. 934,271, filed Aug. 16, 1978 concurrently with the instant application. This application is hereby incorporated by reference.

The ratio of vehicle to solids in the dispersions can vary considerably and depends upon the manner in which the dispersion is to be applied and the kind of vehicle used. Normally, to achieve good coverage, the dispersions will contain complementally 60–90% solids and 40–10% vehicle. The compositions of the present invention may, of course, be modified by the addition of other materials which do not affect its beneficial characteristics. Such formulation is well within the skill of the art.

The pastes are conveniently prepared on a three-roll mill. The viscosity of the pastes is typically within the following ranges when measured on a Brookfield HBT viscometer at low, moderate and high shear rates:

| Shear Rate ($Sec^{-1}$) | Viscosity (Pa.s) | |
|---|---|---|
| 0.2 | 100–5000 | — |
| | 300–2000 | Preferred |
| | 600–1500 | Most preferred |
| 4 | 40–400 | — |
| | 100–250 | Preferred |
| | 140–200 | Most preferred |
| 384 | 7–40 | — |
| | 10–25 | Preferred |
| | 12–18 | Most preferred |

The amount of vehicle utilized is determined by the final desired formulation viscosity.

FORMULATION AND APPLICATION

In the preparation of the composition of the present invention, the particulate inorganic solids are mixed with the organic medium and dispersed with suitable equipment, such as a three-roll mill, to form a suspension, resulting in a composition for which the viscosity will be in the range of about 100–150 pascal-seconds (Pa.s) at a shear rate of 4 $sec^{-1}$.

In the examples which follow, the formulation was carried out in the following manner:

The ingredients of the paste, minus about 5% organic components equivalent to about 5% wt., are weighed together in a container. The components are then vigorously mixed to form a uniform blend; then the blend is passed through dispersing equipment, such as a three roll mill, to achieve a good dispersion of particles. A Hegman gauge is used to determine the state of dispersion of the particles in the paste. This instrument consists of a channel in a block of steel that is 25 μm deep (1 mil) on one end and ramps up to 0" depth at the other end. A blade is used to draw down paste along the length of the channel. Scratches will appear in the channel where the agglomerates' diameter is greater than the channel depth. A satisfactory dispersion will give a fourth scratch point of 10–1 μm typically. The point at which half of the channel is uncovered with a well dispersed paste is between 3 and 8 μm typically. Fourth scratch measurements of §20 μm and "half-channel" measurements of §10 μm indicate a poorly dispersed suspension.

The remaining 5% consisting of organic components of the paste is then added and the resin content is adjusted for proper screen printing rheology.

The composition is then applied to a substrate, such as alumina ceramic, usually by the process of screen printing, to a wet thickness of about 30–80 microns, preferably 35–70 microns and most preferably 40–50 microns. The electrode compositions of this invention can be printed onto the substrates either by using an automatic printer or a hand printer in the conventional manner. Preferably, automatic screen stencil techniques are employed using a 200 to 325 mesh screen. The printed pattern is then dried at below 200° C., e.g., about 150° C., for about 5–15 minutes before firing. Firing to effect sintering of the inorganic binder is carried out in an inert atmosphere such as nitrogen using a belt conveyor furnace. The temperature profile of the furnace is adjusted to allow burnout of the organic matter at about 300°–600° C., a period of maximum temperature of about 800°–950° C. lasting about 5–15 minutes, followed by a controlled cooldown cycle to prevent over-sintering, unwanted chemical reactions at intermediate temperatures, or substrate fracture which can occur from too rapid cooldown. The overall firing procedure will preferably extend over a period of about 1 hour, with 20–25 minutes to reach the firing temperature, about 10 minutes at the firing temperature and about 20–25 minutes in cooldown. In some instances, total cycle times as short as 30 minutes can be used.

SAMPLE PREPARATION

Samples to be tested are prepared as follows:

A pattern of the resistor formulation to be tested is screen printed upon each of ten coded 1×1" 96% alumina ceramic substrates having a presintered copper conductive pattern, allowing to equilibrate at room temperature and then air dried at 125° C. The mean thickness of each set of dried films before firing must be 22–28 microns as measured by a Brush Surfanalyzer. The dried and printed substrate is then fired in nitrogen for about 60 minutes using a cycle of heating at 35° C.

per minute to 900° C., dwell at 900° C. for 9 to 10 minutes, and cooled at a rate of 30° C. per minute to ambient temperature.

TEST PROCEDURES

A. Resistance Measurement and Calculations

The test substrates are mounted on terminal posts within a controlled temperature chamber and electrically connected to a digital ohm-meter. The temperature in the chamber is adjusted to 25° C. and allowed to equilibrate, after which the resistance of the test resistor on each substrate is measured and recorded.

The temperature of the chamber is then raised to 125° C. and allowed to equilibrate, after which the resistors on the substrate are again tested.

The temperature of the chamber is then cooled to −55° C. and allowed to equilibrate and the cold resistance measured and recorded.

The hot and cold temperature coefficients of resistance (TCR) are calculated as follows:

$$\text{Hot } TCR = \frac{R_{125^\circ C.} - R_{25^\circ C.}}{R_{25^\circ C.}} \times (10{,}000) \text{ ppm/°C.}$$

$$\text{Cold } TCR = \frac{R_{-55^\circ C.} - R_{25^\circ C.}}{R_{25^\circ C.}} \times (-12{,}500) \text{ ppm/°C.}$$

The average values of $R_{25^\circ C.}$ and Hot and Cold TCR (HTCR and CTCR respectively) are determined and $R_{25^\circ C.}$ values are normalized to 25 microns dry printed thickness and resistivity is reported as ohms per square at 25 microns dry print thickness. Normalization of the multiple test values is calculated with the following relationship:

$$\text{Normalized Resistance} = \frac{\text{Average Measured Resistance} \times \text{Average Dry Print Thickness, Microns}}{25 \text{ microns}}$$

B. Coefficient of Variance

The coefficient of variance (CV) is a function of the average and individual resistances for the resistors tested and is represented by the relationship $\sigma/R_{av}$, wherein $$\sigma = \sqrt{\frac{\Sigma i(R_i - R_{av})^2}{n-1}}$$

$R_i$=Measured resistance of individual sample
$R_{av}$=Calculated average resistance of all samples ($\Sigma_i R_i/n$)
n=Number of samples
CV=$(\sigma/R_{av})\times 100$ (%)

C. Laser Trim Stability

Laser trimming of thick film resistors is an important technique for the production of hybrid microelectronic circuits. [A discussion can be found in *Thick Film Hybrid Microcircuit Technology* by D. W. Hamer and J. V. Biggers (Wiley, 1972) p. 173ff.] Its use can be understood by considering that the resistances of a particular resistor printed with the same resistive ink on a group of substrates has a Gaussian-like distribution. To make all the resistors have the same design value for proper circuit performance, a laser is used to trim resistances up by removing (vaporizing) a small portion of the resistor material. The stability of the trimmed resistor is then a measure of the fractional change (drift) in resistance that occurs after laser trimming. Low resistance drift—high stability—is necessary so that the resistance remains close to its design value for proper circuit performance.

D. Solder Dip Drift

After initial measurement of resistance, the resistor is dipped in Alpha 611 soldering flux and dipped in 60/40 Pb/Sn molten solder for ten seconds, withdrawn and then dipped for a second ten-second interval. Resistance of the twice-dipped resistor is measured and the change (drift) calculated by comparison with the initial resistance measurement.

E. Drift on Aging at 150° C.

After initial measurement of resistance at room temperature, the resistor is placed into a heating cabinet at 150° C. in dry air and held at that temperature for a specified time (usually 100 or 1,000 hours). At the end of the specified time, the resistor is removed and allowed to cool to room temperature. The resistance is again measured and the change in resistance calculated by comparison with the initial resistance measurement.

F. Hermeticity

This test is performed in the same manner as the preceding Aging Test, except that the air within the heating cabinet is maintained at 90% Relative Humidity (RH) at 40° C. (90% RH/40° C.).

G. Standard Overload Voltage (STOL)

Using a 1 mm×1 mm resistor which has been terminated with copper metal, wire leads are soldered to the copper terminations and the resistor is connected to a DC power source. The resistor is exposed a series of five-second pulses of successively increasing voltage. After each pulse, the resistor is allowed to come to equilibrium and the resistance measured. The sequence is maintained until a 0.1% change in resistance is produced. This voltage is indicated by the term STOL (0.1%). The power input to obtain the overload voltage is calculated as follows:

$$\text{Power (watts/in}^2) = \frac{[STOL\ (0.1\%) \times 0.4]^2}{\Omega} \times 645$$

H. Process Sensitivity

Refire stability: Resistances are measured and resistors refired according to the above procedures. Resistances are measured and % drift is calculated.

Peak temperature stability: Resistors are fired according to the above cycle, but at peak temperatures of 875° C., 900° C. and 925° C. Resistances are measured and peak temperature drift is calculated.

$$\Delta\%/^\circ\ (875\text{–}900) = \frac{(R_{900} - R_{875}) \times 100}{(R_{900} + R_{875})/2) \times 25}$$

EXAMPLES

In the examples which follow, the test specimens were prepared and tested in the manner described above. All proportions are on a molar basis unless expressly indicated otherwise.

EXAMPLES 1-3

Using the procedures outlined above, a series of three compositions was made in which the amount of hexaboride was varied from 60 to 10% and the amount of crystallizable glass from 40 to 90%. The glass contained 11.1% $Ta_2O_5$. The electrical properties of the resistors prepared therefrom show that a wide range of resistivity can be obtained by varying the hexaboride-to-glass ratio. These data are given in Table 1 below.

TABLE 1

EFFECT OF HIGH $Ta_2O_5$ CONTENT

| EXAMPLE NO. | 1 | 2 | 3 |
|---|---|---|---|
| | Mole % | | |
| Glass Composition | | | |
| CaO | 11.6 | 11.6 | 11.6 |
| $B_2O_3$ | 23.2 | 23.2 | 23.2 |
| $SiO_2$ | 42.5 | 42.5 | 42.5 |
| $Al_2O_3$ | 11.6 | 11.6 | 11.6 |
| $Ta_2O_5$ | 11.1 | 11.1 | 11.1 |
| | Wt. % | | |
| Resistor Composition | | | |
| $LaB_6$ | 60 | 15 | 10 |
| Glass | 40 | 85 | 90 |
| Resistor Properties | | | |
| Resistance, Ω/□ | 6.5 | 719 | 19560 |
| HTCR, ppm/°C. | +320 | +150 | −172 |
| Power Handling STOL (0.1%) Watts/in$^2$ | — | 110 | 60 |
| | -- | 1736 | 19 |

EXAMPLES 4-7

A series of four resistor compositions was prepared in which 5.9% $Ta_2O_5$ was used in the glass, which amount seems to be an optimum concentration. The electrical data of the resistors made therefrom show excellent process stability, especially at high resistivity. X-ray diffraction studies of the resistors show the presence of $LaB_6$, $TaB_2$ and $CaTa_4O_{11}$, the latter two of which were formed upon firing. These data are shown in Table 2 below.

TABLE 2

EFFECT OF HIGH $Ta_2O_5$ ADDITION

| EXAMPLE NO. | 4 | 5 | 6 | 7 |
|---|---|---|---|---|
| Glass Composition (Mole %) | | | | |
| CaO | 12.25 | | | |
| $B_2O_3$ | 24.50 | | | |
| $SiO_2$ | 45.08 | | | |
| $Al_2O_3$ | 12.20 | | | |
| $Ta_2O_5$ | 5.90 | | | |
| Resistor Composition (Wt. %) | | | | |
| $LaB_6$ | 49.36 | 21.85 | 10.0 | 6.6 |
| Frit | 37.97 | 72.66 | 90.0 | 93.4 |
| TiO | 12.66 | 5.49 | — | — |
| Resistor Properties | | | | |
| Pre-trim Properties | | | | |
| Ω/□/25μ | 7.524 | 82.1 | 904.6 | 14880 |
| CV % | 0.83 | 1.24 | 2.0 | 3.6 |
| HTCR | +26 | +104 | +95 | −160 |
| X-ray | | | | |
| $LaB_6$ | Strong | Strong | None | None |
| $TaB_2$ (broad) | Weak | Weak | Strong | Strong |
| $CaTa_4O_{11}$ | None | None | Medium | Strong |
| Process Sensitivity | | | | |
| Refire Δ% | +16 | −16 | +7.1 | −3.1 |
| Δ/° 875-900° C. | −0.17 | −1.0 | −2.7 | −1.2 |
| Δ/° 900-925° C. | −0.03 | −1.6 | +0.24 | −1.5 |

TABLE 2-continued

EFFECT OF HIGH $Ta_2O_5$ ADDITION

| EXAMPLE NO. | 4 | 5 | 6 | 7 |
|---|---|---|---|---|
| Laser Trim Stability[1] (Δ%) | | | | |
| 60 hr | 0.64 | −0.04 | −0.04 | 0.06 |
| 360 hr | 0.74 | 0.006 | 0.15 | 0.25 |
| 90% RH/40° C. 60 hr | 1.5 | 0.15 | −0.02 | 0.10 |
| 360 hr | 2.2 | 0.40 | 0.26 | 0.38 |
| 150° 60 hr | 2.0 | 0.07 | 0.19 | 0.20 |
| 360 hr | 3.2 | 0.12 | 0.42 | 0.48 |
| STOL (0.1) | 30 | 45 | 120 | 35 |
| Watts/in$^2$ | 11,326 | 2985 | 1769 | 7[2] |
| Solder dip Δ% 2 × 10 sec. | 0.08 | 0.06 | 0.01 | 0.02 |

[1]× 1.5, 40 × 40 mils, room temperature
[2]STOL (0.5 = 65 (24 watts/in$^2$)

EXAMPLES 8-16

Three further series of resistor compositions was prepared in which $Ta_2O_5$ was added to the crystallizable glass at levels of 2%, about 4% add at 7.6%. The resistors which contained only 2% $Ta_2O_5$ (Examples 8-10) exhibited no glass crystallization and were markedly inferior with respect to process stability. The resistors which contained about 4% $Ta_2O_5$ (Examples 11-13) also exhibited no crystallization of the glass and the resistors had poor refiring stability. However, the resistors in which the glass contained more than 5% $Ta_2O_5$ exhibited crystallization of the glass and resistor refire stability was greatly improved thereby. These data are given in Table 3 below.

TABLE 3

EFFECT OF $Ta_2O_5$ ADDITION LEVEL

| EXAMPLE NO. | 8 | 9 | 10 |
|---|---|---|---|
| Glass Composition (Mole %) | | | |
| CaO | 12.69 | 12.69 | 12.69 |
| $B_2O_3$ | 25.38 | 25.38 | 25.38 |
| $SiO_2$ | 46.78 | 46.78 | 46.78 |
| $Al_2O_3$ | 12.69 | 12.69 | 12.69 |
| $Ta_2O_5$ | 2.0 | 2.0 | 2.0 |
| Resistor Composition (Wt. %) | | | |
| $LaB_6$ | 27.0 | 13.63 | 6.63 |
| Glass | 66.66 | 77.27 | 93.3 |
| TiO | 6.025 | 9.09 | 0.0 |
| Resistor Properties | | | |
| X-ray | | | |
| $LaB_6$ | Strong | Strong | None |
| $TaB_2$ (broad) | Weak | Weak | Strong |
| $CaTa_4O_{11}$ | None | None | None |
| KΩ/□ | 0.094 | 974 | 12,210 |
| HTCR ppm/° | +125 | +175 | −35 |
| CV % | 4.4 | 4.3 | 5.8 |
| Refire Δ% | — | −44 | −20 |
| Peak Temperature | | | |
| Δ %/° 875-900 | −1.73 | −7.0 | ∞ |
| Δ %/° 900-925 | −0.4 | −5.0 | −7.9 |
| EXAMPLE NO. | 11 | 12 | 13 |
| Glass Composition (Mole %) | | | |
| CaO | 12.51 | 12.51 | 12.51 |
| $B_2O_3$ | 24.97 | 24.97 | 24.97 |
| $SiO_2$ | 46.05 | 46.05 | 46.05 |
| $Al_2O_3$ | 12.51 | 12.51 | 12.51 |
| $Ta_2O_5$ | 3.95 | 3.95 | 3.95 |
| Resistor Composition (Wt. %) | | | |
| $LaB_6$ | 60 | 20 | 10 |
| Glass | 40 | 80 | 90 |
| KΩ/□/25μ | 0.00566 | 0.601 | 5.675 |
| CV % | — | — | 2.1 |
| HTCR | +275 | +16 | +40 |
| Refire Δ% | −7.4 | −41.0 | −45 |
| X-ray | | | |
| $LaB_6$ | Strong | None | — |

TABLE 3-continued

| EFFECT OF $Ta_2O_5$ ADDITION LEVEL | | | |
|---|---|---|---|
| $TaB_2$ (broad) | Weak | Strong | — |
| $CaTa_4O_{11}$ | None | None | — |
| EXAMPLE NO. | 14 | 15 | 16 |
| Glass Composition (Mole %) | | | |
| CaO | 12.04 | 12.04 | 12.04 |
| $B_2O_3$ | 24.06 | 24.06 | 24.06 |
| $SiO_2$ | 42.27 | 42.27 | 42.27 |
| $Al_2O_3$ | 12.03 | 12.03 | 12.03 |
| $Ta_2O_5$ | 7.6 | 7.6 | 7.6 |
| Resistor Compositions (Wt. %) | | | |
| $LaB_6$ | 6.66 | 13.33 | 60 |
| Glass | 93.33 | 86.66 | 40 |
| KΩ/□/25μ | 158 | 0.580 | 0.0075 |
| CV % | 8.5 | 1.5 | 2.3 |
| HTCR | −647 | 335 | +335 |
| X-ray | | | |
| $LaB_6$ | None | — | Strong |
| $TaB_2$ (broad) | Strong | — | Medium |
| $CaTa_4O_{11}$ | Strong | — | None |
| Refire Δ% | −33 | +16 | +8 |

I claim:

1. A composition for the preparation of thick film resistors comprising an admixture of finely divided particles of:

A. 2–70% by weight, basis total solids, of conductive metal hexaboride selected from the group consisting of $LaB_6$, $YB_6$, rare earth hexaboride, $CaB_6$, $SrB_6$ and mixtures thereof; and B. 98–30% by weight, basis total solids, of an alkali metal or alkaline earth metal aluminosilicate crystallizable glass comprising 70–95 mole % components which are irreducible by the conductive metal hexaboride having dissolved therein 30–5 mole % $Ta_2O_5$.

2. The composition of claim 1 in which the crystallizable glass is an alkaline earth metal boroaluminosilicate.

3. The composition of claim 1 in which the glass contains 5–10% $Ta_2O_5$.

4. The composition of claim 1 in which the conductive metal hexaboride is $LaB_6$.

5. The composition of claim 1 in which the particle size of the conductive metal hexaboride is less than one micron.

6. A screen printable composition comprising the composition of claim 1 dispersed in organic medium.

7. The method of making a resistor element comprising the sequential steps of (a) forming a dispersion in organic medium of the composition of claim 1; (b) forming a patterned thin layer of the dispersion of step (a); (c) drying the layer of step (b); and (d) firing the dried layer of step (c) in a nonoxidizing atmosphere to effect reduction of the $Ta_2O_5$, volatilization of the organic medium, and liquid phase sintering of the glass.

8. A resistor comprising a patterned thin layer of the dispersion of claim 6 which has been dried and fired in a nonoxidizing atmosphere to effect reduction of the $Ta_2O_5$, volatilization of the organic medium and liquid phase sintering of the glass.

* * * * *